United States Patent [19]

Long et al.

[11] Patent Number: 5,051,723

[45] Date of Patent: Sep. 24, 1991

[54] SIGNALLING SYSTEM WITH AMBIENT CONDITION REFERENCE MONITORING

[75] Inventors: George E. Long, 11821 - 219th Ave., SE., Monroe, Wash. 98272; Daniel R. Asmussen, Kirkland; Martin J. Kenney, Redmond, both of Wash.

[73] Assignee: George E. Long, Monroe, Wash.

[21] Appl. No.: 414,701

[22] Filed: Sep. 29, 1989

[51] Int. Cl.[5] ..... G08B 13/02

[52] U.S. Cl. ..... 340/566; 340/429

[58] Field of Search ..... 340/566, 429, 683, 587

[56] References Cited

U.S. PATENT DOCUMENTS

| | | | |
|---|---|---|---|
| 3,614,724 | 10/1971 | Brown et al. | 340/566 |
| 3,665,312 | 5/1972 | Jarvis | 340/426 |
| 3,852,740 | 12/1974 | Haynes | 340/416 |
| 3,868,691 | 2/1975 | Miller et al. | 342/389 |
| 4,104,635 | 8/1978 | Brodeur | 423/242 |
| 4,167,733 | 9/1979 | Krause | 340/539 |
| 4,188,622 | 2/1980 | Miller et al. | 340/571 |
| 4,262,283 | 4/1981 | Chamberlain et al. | 340/533 |
| 4,284,983 | 8/1981 | Lent | 340/568 |
| 4,315,244 | 2/1982 | Cole, Jr. | 340/427 |
| 4,337,462 | 6/1982 | Lemelson | 340/572 |
| 4,388,616 | 6/1983 | Machida | 340/587 |
| 4,479,113 | 10/1984 | McNeilly et al. | 340/566 |
| 4,536,747 | 8/1985 | Jenson | 340/502 |
| 4,591,860 | 5/1986 | Fukuhara | 342/390 |
| 4,593,273 | 6/1986 | Narcisse | 340/539 |
| 4,642,612 | 2/1987 | Crump | 340/541 |
| 4,665,383 | 5/1987 | Desjardins | 340/506 |
| 4,686,513 | 8/1987 | Farrar et al. | 340/572 |
| 4,845,464 | 7/1989 | Drori et al. | 340/429 |
| 4,922,230 | 5/1990 | Ohtani et al. | 340/587 |
| 4,927,683 | 10/1981 | Roberts | 340/539 |

*Primary Examiner*—Glen R. Swann, III

*Attorney, Agent, or Firm*—Carl G. Dowrey

[57] ABSTRACT

A self-contained theft and vandalism deterrent system for equipment security includes sensors (12) for detecting conditions to which an alarm (24, 26, 28, 50) is responsive. The analog signals from the sensors (12) are serially delivered by a multiplexer circuit (16) when they are then directed to a network (20) for conversion to digital signals. The digital signals are delivered to a micro processor (22) where the signals are evaluated to determine if an alarm condition exists. The sensing means (12) include sound and vibration detectors for monitoring the ambient envelope. The micro processor (22) includes built in reprogramming and comparator circuits for varying the level at which a given condition will trigger an alarm response.

15 Claims, 1 Drawing Sheet

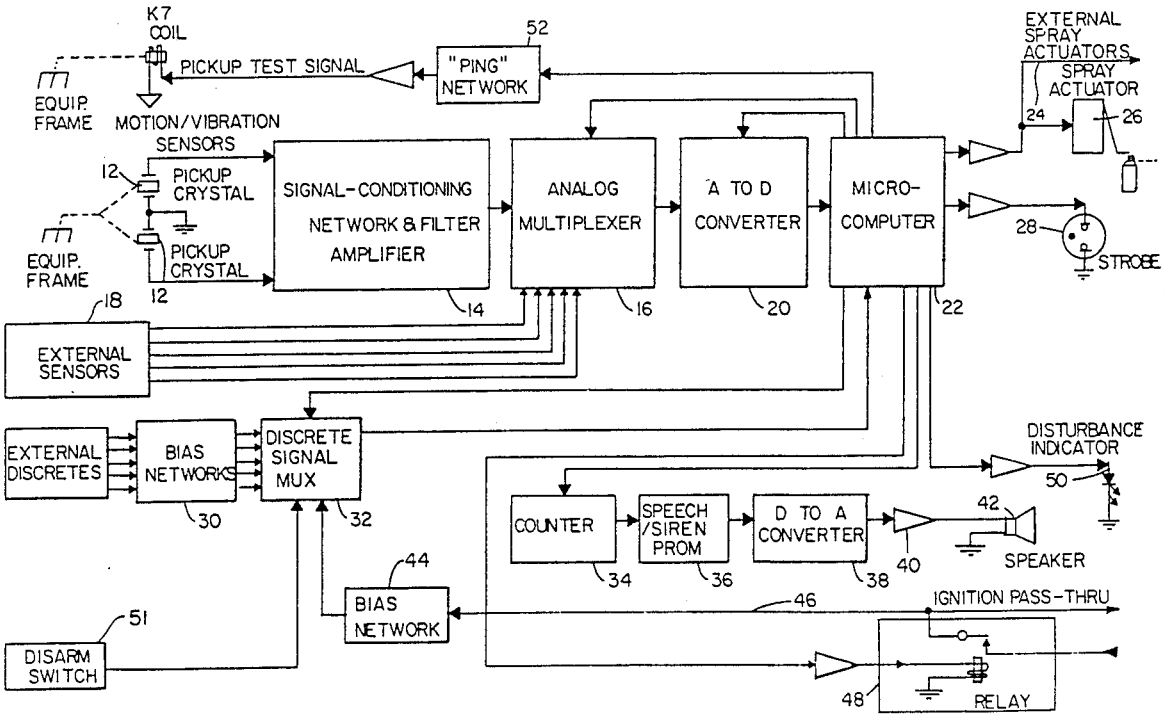

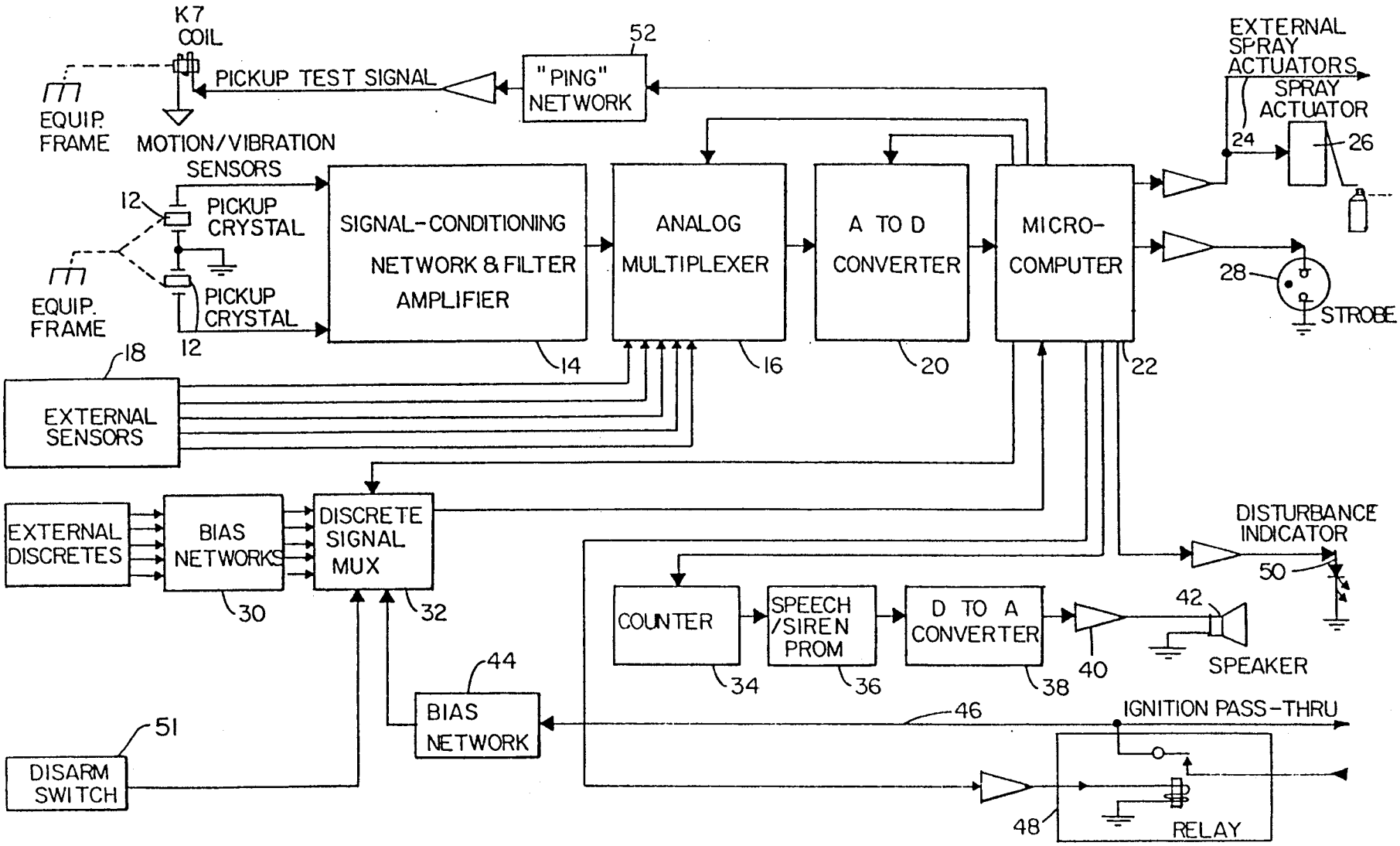
EXTERNAL SPRAY ACTUATORS
SPRAY ACTUATOR
26
24
STROBE
28
DISTURBANCE INDICATOR
50
SPEAKER
42
IGNITION PASS-THRU
RELAY
48
MICRO-COMPUTER
22
A TO D CONVERTER
20
ANALOG MULTIPLEXER
16
SIGNAL-CONDITIONING NETWORK & FILTER AMPLIFIER
14
D TO A CONVERTER
38
40
SPEECH /SIREN PROM
36
COUNTER
34
46
"PING" NETWORK
52
PICKUP TEST SIGNAL
K7 COIL
EQUIP. FRAME
MOTION/VIBRATION SENSORS
PICKUP CRYSTAL
PICKUP CRYSTAL
12
12
EQUIP. FRAME
EXTERNAL SENSORS
18
DISCRETE SIGNAL MUX
32
BIAS NETWORK
44
BIAS NETWORKS
30
EXTERNAL DISCRETES
DISARM SWITCH
51

SIGNALLING SYSTEM WITH AMBIENT CONDITION REFERENCE MONITORING

DESCRIPTION

1. Technical Field

The invention relates generally to the field of security systems and more particularly does it relate to an ambient envelope theft and vandalism deterrent system which is especially designed for use by contractors and builders to protect equipment in addition to security of goods and containers in the transportation, storage and like industries.

2. Background Art

Security systems which provide signals from a single or a plurality of sensors in order to produce an appropriate alarm are well known in the art. However, the prior art does not adequately provide an alarm system for detecting a particular sequence and or combination of events nor does it provide flexibility for several levels of response. In short the detection criteria of prior art systems do not adequately provide for tailoring a system to a particular user's requirements.

As those skilled in the art are well aware, theft and vandalism of construction, transportation and storage equipment is a major problem in industry. Crime losses on construction job sites, for example, continue to increase each year with theft of equipment being the major concern. The most frequently stolen items are hand tools, generators, air compressors and other small pieces of equipment. As a result of the crime problems plaguing the industry it has become increasingly important for contractors and builders to provide alarm protection an deterrence to theft, tampering and vandalism for mobile and portable construction moving equipment, tools and machinery on the job site during non-use hours.

Among the problems of the prior art systems is the fact that the systems are too complicated and sophisticated and therefore far too expensive. Accordingly it is of particular concern to contractors and builders that there be detection of site intrusion, movement, change of location or tampering With equipment. Such detection monitoring involves a number of condition parameters and provides deterrent response on several levels. It is desirable that on one level, theft and vandalism/tampering detection be self contained and not dependent on local or remote monitoring by computer or human operators.

Among the prior art systems relating to this field of which applicants are aware are the following United States patents.

U.S. Pat. No. 4,337,462, Lemelson, discloses a system employing micro miniature electronic circuitry supported or hidden within an article of value such as a work of art, furniture, manufacturing or maintenance equipment, etc. and which when activated generates a short wave signal. The signal is transmitted either directly to a monitor station or to an electronic transponder which retransmits to a monitor station The monitor station thus traces movement of the item, its location and identification and in some instances the route along which it is being moved. This patented system does not relate to a self contained, on site self activating alarm system such as that herein disclosed and claimed.

U.S. Pat. No. 4,536,747, Jensen, is directed to a sophisticated system using a plurality of preprogrammable and reprogrammable condition responsive detectors at remote location each having the ability to transmit signals to a central monitoring control location. The system of this patent includes means for selectively reprogramming the logic means during its operation. The central control location provides a choice of multiple response actions, either automatic or manual, to the sensed conditions at the remote locations. Transmitter means are provided at each remote location for transmitting signals to the control console. The system of this patent is a more complicated, non-self contained security system, but is of interest because of its inclusion of the ability for reprogramming the conditions to which the detectors will be responsive.

U.S. Pat. No. 4,665,383, Desiardins, discloses a system primarily for fire security in buildings. The detector sensors, located to sense heat, smoke, and methane gas for example, are connected through telephone or power lines to central control circuits which provide appropriate response to sensed conditions. This patent also is of interest only for its showing of multiple condition responsive sensors. It is otherwise not relevant to this invention.

Other United States patents of which applicants are aware are: Nos. 3,852,740 to Haymes; 4,262,283 to Roberts; 4,297,683 and 4,593,273 to Harcisse. None of these are germane to the disclosure and claims herein.

SUMMARY OF THE INVENTION

The theft and vandalism deterrent security system of this invention is an ambient envelope monitoring system which is a self contained unit which is incorporated in a small tamper proof housing securely attached at almost any location on a vehicle or other piece of equipment. For larger pieces of equipment such as dump trucks, earth movers, bulldozers, graders, or containers, sensors for units of the invention may or will be placed in several locations and hardwired to the electronics box located in a safe location as for instance in the cab under the operator's seat. These units will include in the electronics, circuitry to process signals from the sensors which will monitor a variety of alarmable parameters. The electronics contain control circuits for varying sensor sensitivity without need for operator input. Upon screening the sensor signals the electronics will be able to respond on several levels by being in turn hard wired to alarm responses such as for example high frequency sounds, dye sprays, strobe lights and voice warning speakers.

Accordingly, it is among the features of this invention to provide a theft and vandalism deterrent system for mobile and portable construction and moving equipment, tools and machinery during non-use hours on a job site. The system is relatively inexpensive since it is self contained. It is also rugged for broad temperature ranges and high impact and shock tolerance. It is deactivated during equipment in-use hours.

The system is easily installed and may be removed and stored while the equipment is in use and is adaptable to both large and small equipment. The units of the system operate on equipment battery power but include self contained back up battery power. The invention is self testing with respect to its external sensors and its own battery. Each unit of the invention is armed and disarmed by number pad coding but may be armed and disarmed by other means such as by key, magnetic card and the like. The system monitors a broad range of condition parameters including but not limited to battery power, ignition switch condition, lights, metal conducted acoustical disturbances that are audible, sub-audible or ultrasonic. Additional condition parameters which may be or are sensed are motion or relocation and temperature changes.

The system is designed to be adaptable to background acoustical noise levels, programmed to accept gradual temperature changes both ambient and equipment cooling, and programmed to discriminate sound frequency and noise level profiles. Units of the invention are designed to respond with synthesized voice warnings, screech alarms or strobe lights or other forms of alarm responses. It will be apparent to those skilled in the art that the signals could be transmitted by radio or satellite or interfaced with phone lines or other means of communication.

BRIEF DESCRIPTION OF DRAWING

The single figure is a block diagram of the electronics for the system of this invention.

BEST MODE FOR CARRYING OUT THE INVENTION

The self contained units of this invention will be contained in a tamper proof housing measuring for instance approximately 5.0×6.0×2.5 inches. It will include acoustical sensor, audible and visual annunciators, signal processing circuits, microprocessor and memory circuits, standby battery, protected external electrical connectors and arming/disarming means. The housing will be made of heavy gauge metal or other suitable material such as plastic with protected entrances and openings and will be water and caustic resistant and include a double moisture barrier for protection of the internal circuits. Mounting of the internal components within the housing will be such as to offer resistance to vibration and shock. Also selection of components will be with the purpose of withstanding temperature extremes beyond those expected in the field.

As seen in the drawing, as at number 12, one or a plurality of sensors are positioned at various points on the frame or body of for example a grader. The sensors 12 attach to a Piece of equipment and may be a motion or vibration microphone sensor, a coil, strain gauge, or audio transducer for picking up the condition which will indicate theft, vandalism or tampering.

The system is designed to monitor a broad spectrum of acoustical disturbances conducted via frame and metal parts. The spectra range from sub-audible for motion, through audibility for the human ear to near ultrasonic frequency ranges. The vibration, sound and motion-to-electrical transducers are attached to the equipment's metal parts which are not otherwise cushioned or isolated with respect to the frame or body. In this way one or more crystal or magnetic sensors are attached to 'listen' to all physical disturbances over the range or spectrum of noise.

The transducer pickups 12 convert the mechanical disturbances into electrical analog signals which are directed to the signal conditioning network and filter amplifier 14. It is recognized that pickups 12 could produce digital signals. Circuitry 14 accepts the signals and conditions them with the active filter networks to scale for amplitude and shape and then separates them into groups of frequencies within the acoustical spectrum to produce several discrete output voltage analog signals proportional to the several frequency ranges.

The analog signals from the band pass filter amplifier 14 are directed then to the multiplexer 16 which accepts a separate signal for each range of frequency received. Multiplexer 16 not only accepts the voltage input signals from network 14 but it also receives discrete signals from each of the external sensors 18, representing a number of parameters such as for example ambient temperature, equipment temperature, motion, pressure, weight and so forth. Multiplexer 16 looks at each line and incoming signal separately and then sequentially outputs the incoming signals to converter network 20 where the voltage analog is converted to a binary digital signal to be directed to the micro-computer 22.

The analog signals thus formed and converted to digital signals are sent to the microcomputer which is part of the self contained detection unit within the housing. The microcomputer is capable of controlling the scale factors or level sensitivities of the various sensors by controlling the triggering level at which a particular sensor is made to respond. Such capability greatly extends the useful dynamic range of the transducer sensors and permits evaluation of acoustical spectra in the presence of high or low background levels of noise, vibration or motion. It will be appreciated that background noise which could influence the system could be automotive, railroad, aircraft or other equipment noise or traffic of a predetermined distance or intensity.

Microcomputer 22 is contained within the housing and includes the entire program for making the decision on each signal received or on a plurality of input signals. In the case of the digitally converted acoustical signals the same are continuously evaluated against a model programmed into the microprocessor's permanent PROM memory. By comparing the input signals against the program model the processor 22 makes a decision whether or not an alarm condition exists. In effect the model programmed into the processor creates a record of time/acoustical spectrum/intensity exceedences which are recorded into the processor's working RAM memory to be further evaluated against timing factors also programmed into the PROM. A three criteria evaluation of the disturbance is thus established while the exceedence values are held in the processor RAM each with a time stamp. If any succession of evaluated disturbances measured against the time/spectrum/intensity exceedences persists over a few seconds, the entire succession of disturbances is recorded into non-volatile EEPROM or battery backed RAM for future evaluation.

Besides the acoustical pickup signals processed to the microcomputer 22 there are or may be discrete inputs 30 from external means such as power on, power off switches, and over heating switch means. These are bias factors or modification parameters which must be conveyed to the microcomputer via the multiplexer 32 which again outputs its received signals as described with respect to network 16.

The initial alarm responses may take a number of forms depending on the desires of the user whether in construction, transportation or storage industries. The processor 22 may be able to respond on several levels as for instance with a dye spray 24, mace 26, strobe light 28, and/or synthesized voice speaker 42. Speaker 42 will be controlled by a counter 34 which is signalled by the processor to tell the speaker to use one of a plurality of synthesized voice, screech or siren type alarms. Again a digital to analog converter 38 enables the speaker to be driven with the particular response desired. A bias network converts external battery power to the 5 volt system for the processor 22. The bias network 44 is connected to ignition by-pass line 46 but the system also includes means 48, such as a solenoid, for shutting off the ignition if an alarm condition exists. LED's 50 may if desired be mounted on the control housing to indicate a disturbance. A disarm switch 51 may also be provided in the system for manually disarming the system if necessary.

A number or alarm options are permitted in this type of system including an initial audible voice warning. If the disturbance persists the system may then go to a screech alarm or if after a timed interval the disturbance has stopped the system will automatically shut down. All exceedences which are evaluated as potential alarms, whether or not an audible alarm is issued, are recorded into non-volatile memory for later off line computer evaluation. Any disturbance which results in such a recording activates a visual indicator 50 in the control housing. Subsequent re-arming of the unit will reset the indicator 50 but the previous record will be retained until subsequent events cause the capacity of the non-volatile memory to be exceeded.

Once an initial but not yet alarmable disturbance has occurred, the unit may be programmed to increase its evaluation time in stages, re-shape its spectral pattern either to adapt to changes in ambient acoustical levels or select specific spectrum/time envelopes for greater scrutiny. For the purposes of this disclosure the term 'envelope' means the ambient acoustical or noise pattern as it exists at particular times during non-use hours.

Another criterion which may be required as part of the disturbance evaluation algorithm is temperature of one or more parts of the protected equipment. It may be important to determine the probability of thermal pops or cracks which occur as machinery cools down after use. Also the system must consider rapid changes in ambient air temperature. Any abrupt change in temperature of any monitored engine parts will result in an alarm unless the unit has been disarmed. For instance if the equipment has been parked for the night and the unit armed, the system must accept noises from the cooling engine until the engine temperature drops to a threshold value of for example 80 degrees. Additionally, a broad spectrum sensor microphone acoustically isolated from the equipment may be required to separately evaluate ambient sound and vibration levels near the equipment.

Each unit will be provided with an inaudible pulse generator which will attach to the equipment's metal parts for the purpose of 'ping' testing the equipment. Signals for the ping network 52 are provided by processor 22 to generate a return signal which if not received or if delayed may constitute an alarm condition. The 'ping' testing exists as a means for testing the audibility sensors and to calibrate the same.

In its operation the theft and vandalism deterrent system of this invention is designed so that the ambient conditions such as noise, temperature, vibration, light and other conditions, are monitored on a scheduled or induced basis with the results forming an 'ambient envelope.' The envelope will change due to changing conditions, such as that of an engine cooling after it is turned off with resultant noises and vibrations. Another example would be parking a piece of equipment alongside a freeway where the noise level and vibration would be substantially different between peak afternoon traffic hours and early pre-dawn hours of the morning. The 'ambient envelope' is continuously modified by monitoring the same to accommodate those changes. The alarm system is activated when an event occurs which is outside the ambient envelope. Thus, there is provided an alarm system which is constantly tuned to or compatible with normal ambient condition.

We claim:

1. An alarm system for generating an alarm signal responsive to a sensed condition under surveillance wherein said sensed condition is compared to a reference condition for determining if an alarm signal is to be generated, said system comprising in combination, (a) alarm signal generating means, (b) ambient condition monitoring means including first sensing means for monitoring at least one given ambient condition and for generating a reference signal representing said ambient condition, (c) second sensing means for generating a surveillance signal responsive to said sensed condition under surveillance, (d) and signal comparing means for comparing said reference signal and said surveillance signal, said alarm signal generating means being actuated by a sensed condition signal if said surveillance signal exceeds said reference signal by a predetermined amount, whereby the alarm system is activated when a sensed condition occurs which is outside the ambient envelope, thereby providing an alarm system with a reference signal which is constantly changed in response to constantly changing ambient conditions.

2. The alarm system according to claim 1 wherein said ambient condition monitoring means includes ambient noise monitoring means for monitoring ambient noise levels.

3. The alarm system according to claim 1 wherein said first and second sensing means generate electrical analog signals which are converted to electrical digital signals.

4. The alarm system according to claim 3 wherein said second sensing means detect a predetermined frequency range of acoustical disturbances, and wherein network means are included for separating the acoustical disturbances into frequency bands and outputting a discrete output voltage analog signal proportional to the disturbances sensed in each frequency band.

5. A theft and vandalism alarm system for an item of equipment, said system including electronic control means comprising, (a) an alarm signal generating means including at least one sensor means for transmitting at least one surveillance signal representative of a condition under surveillance sensed by said sensor means, (b) ambient condition monitoring means for monitoring at least one given ambient condition and for generating a reference signal representing said ambient condition, (c) said electronics including first network means for accepting said surveilance signals and separating the same into a predetermined group of frequency ranges, the signals in each of said group of frequency ranges being converted to a discrete signal, (d) second network means for receiving each of said discrete signals and said reference signals and sequentially outputting the same, and (e) a microprocessor receiving the output of said second network means for determining whether said frequency range signals represent an alarm condition, said microprocessor being adapted to activate said alarm signal generating means if frequency range signals received therein are evaluated to exceed a predetermined level.

6. The theft and vandalism deterrent system according to claim 5 wherein said discrete output signals are voltage analog signals.

7. The theft and vandalism deterrent system according to claim 5 and wherein a third network means is provided for receiving and converting said discrete signals into digital signals.

8. An alarm system for generating an alarm signal responsive to a sensed condition wherein said sensed condition is compared to a reference condition for determining if an alarm signal is to be generated, said system comprising in combination, (a) alarm signal generating means, (b) ambient condition monitoring means including a first sensing means for sampling at least one given ambient condition at predetermined intervals and for generating a reference signal representing an ambient reference condition, (c) second sensing means for generating at least one surveillance signal responsive to a sensed condition under surveillance, (d) said alarm system including first network means for accepting said at least one surveillance signal and separating the same into a predetermined group of frequency bands, the surveillance signals sensed in each of said bands being converted to a discrete signal, (e) second network means for receiving each of said discrete signals and said reference condition signal and sequentially outputting the same, and (f) microprocessor means for receiving the output of said second network means for determining whether said discrete signals represent an alarm condition, said microprocessor means being adapted to activate said alarm signal means if the discrete signals received therein are evaluated to exceed a predetermined level.

9. A theft and vandalism deterrent system for an item of equipment including a self contained electronics control housing adapted to be secured to said item of equipment at a predetermined location thereon and being adapted to be connected to an external power source as well as having self contained pwoer, said system further including, (a) a plurality of monitoring means for said system which are connected to said control housing including a plurality of first sensing means for transmitting a plurality of signals representative of constantly changing conditions sensed by said monitoring means to the electronics within said control housing in the form of electrical analog signals to establish constantly changing reference levels, (b) second sensor means for generating at least one surveillance signal responsive to a sensed condition under surveillance, (c) said signal including at least a noise level condition which, if above a predetermined reference level, results in generation of an alarm and, if below said reference level, results in generation of no alarm, said reference level representing ambient noise conditions and being changed by said electronics to conform to continuous changes in ambient noise in proximity to said item of equipment, (d) said electronics including first network means for accepting said surveillance signals and separating the same into a predetermined group of frequency bands, the surveillance signals sensed in each of said bands being converted to a discrete voltage analog signal, (e) second network means for receiving each of said discrete voltage analog signals and said reference level signals and sequentially outputting the same, (f) third network means for receiving and converting said discrete voltage analog signals to digital frequency range signals, and (g) a microprocessor receiving the output of said second network means for determining whether said digital signals represent an alarm condition by comparing said digital signals with said reference level, said microprocessor being adapted to activate any one of a plurality of alarm responses if digital signals received therein are evaluated to exceed said reference level by a predetermined amount.

10. An alarm system for generating an alarm signal responsive to a sensed condition under surveillance wherein said sensed condition is compared to a reference condition for determining if an alarm signal is to be generated, said system comprising in combination, (a) alarm signal generating means, (b) ambient condition monitoring means including first sensing means for sampling at least one given ambient condition at predetermined intervals and for generating a reference signal representing an ambient reference condition, (c) second sensing means for generating a surveillance signal responsive to a sensed condition under surveillance (d) signal comparing means for comparing said reference signal and said surveillance signals, (e) said alarm signal generating means being actuated by a sensed condition signal if said surveillance signal exceeds said reference signal by a predetermined amount, whereby the alarm system is activated when a sensed condition occurs which is outside the ambient envelope, thereby providing an alarm system with a reference signal which is changed with changing ambient conditions.

11. The alarm system according to claim 10 wherein said signal comparing means comprises programmable data processing means.

12. A method of detecting and signalling levels of a given condition associated with an area under surveillance which fall outside predetermined parameters comprising the steps of;

monitoring ambient levels of said given condition and generating a reference signal representing an existing ambient envelope reference condition, sensing the given condition in the area under surveillance and generating a separate surveillance signal representative of the sensed condition in the area of surveillance, using a programmable data processor to compare said reference signal and said surveillance signal and to actuate a response signal when a comparison of the surveillance and reference signals indicates the level of the given condition in the area under surveillance is outside said predetermined parameters according to a model programmed into said data processor.

13. The method according to claim 12 wherein said given condition comprises mechanical disturbances, said method including the steps of;

converting said mechanical disturbances to electrical analog signals comprising said surveillance signals, and separating the surveillance signals into frequency bands and outputting a discrete voltage analog signal proportional to the surveillance signals in each frequency band.

14. The method according to claim 13 including the step of;

converting said electrical analog signals to electrical digital signals.

15. The method according to claim 13 wherein said mechanical disturbances comprise acoustical disturbances.

* * * * *